US006616260B2

(12) United States Patent
Skene et al.

(10) Patent No.: US 6,616,260 B2
(45) Date of Patent: Sep. 9, 2003

(54) ROBUST BIT SCHEME FOR A MEMORY OF A REPLACEABLE PRINTER COMPONENT

(75) Inventors: John M Skene, Lake Oswego, OR (US); Matthew A Shepherd, Vancouver, WA (US); Garrard Hume, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/866,040

(22) Filed: May 25, 2001

(65) Prior Publication Data

US 2002/0175965 A1 Nov. 28, 2002

(51) Int. Cl.[7] ..... B41J 2/175
(52) U.S. Cl. ..... 347/19
(58) Field of Search ..... 714/800, 803, 714/801, 763, 716, 773; 399/8, 12, 24; 347/19, 86; 400/207, 208, 175; 365/200

(56) References Cited

U.S. PATENT DOCUMENTS

| | | | | |
|---|---|---|---|---|
| 3,599,146 A | * | 8/1971 | Weisbecker | 365/200 |
| 4,872,027 A | | 10/1989 | Buskirk et al. | |
| 4,973,993 A | | 11/1990 | Allen | |
| 5,247,522 A | * | 9/1993 | Reiff | 714/716 |
| 5,491,540 A | | 2/1996 | Hirst | |
| 5,574,484 A | | 11/1996 | Cowger | |
| 5,583,545 A | | 12/1996 | Pawlowski, Jr. et al. | |
| 5,610,635 A | * | 3/1997 | Murray et al. | 347/19 |
| 5,682,140 A | | 10/1997 | Christensen et al. | |
| 5,699,091 A | | 12/1997 | Bullock et al. | |
| 5,788,388 A | | 8/1998 | Cowger et al. | |
| 5,812,156 A | | 9/1998 | Bullock et al. | |
| 5,835,817 A | | 11/1998 | Bullock et al. | |
| 5,930,553 A | | 7/1999 | Hirst et al. | |
| 6,039,430 A | | 3/2000 | Helterline et al. | |
| 6,113,208 A | | 9/2000 | Benjamin et al. | |
| 6,126,265 A | | 10/2000 | Childers et al. | |
| 6,151,039 A | | 11/2000 | Hmelar et al. | |

FOREIGN PATENT DOCUMENTS

| | | |
|---|---|---|
| EP | 0956963 A1 | 11/1999 |
| EP | 1027986 A1 | 8/2000 |
| EP | 1078759 A1 | 2/2001 |
| EP | 1080917 A1 | 3/2001 |
| EP | 1136268 A1 | 9/2001 |

OTHER PUBLICATIONS

Error Protection for Memory Addressing, IBM Technical Disclosure Bulletin, Oct. 1, 1995, vol. 38, Issue No. 10, pp. 297–298.*

A copy of PCT International Search Report for International Application No. PCT/US02/16507 mailed on Jul. 31, 2002 (5 pages).

* cited by examiner

*Primary Examiner*—Judy Nguyen
*Assistant Examiner*—Julian D. Huffman

(57) ABSTRACT

A system and method for detecting an error in data received from a memory of a replaceable printer component includes providing a first parity bit associated with a first data item. The first data item and the first parity bit are stored in the memory. The printer includes a plurality of electrically conductive lines. The memory includes a plurality of bits. At least one of the electrically conductive lines is associated with each bit. The first data item and the first parity bit are read from the memory. An electrical test of at least one of the electrically conductive lines is performed. An error in the first data item is identified based on the first parity bit read from the memory and the electrical test.

48 Claims, 5 Drawing Sheets

| | Parity (506) | Bit 1 (508A) | Bit 2 (508B) | Bit 3 (508C) | Bit 4 (508D) |
|---|---|---|---|---|---|
| Example 1 (502) | 0 | 0 | 0 | 1 | 1 |
| Example 2 (504) | 1 | 1 | 0 | 0 | 0 |

Fig. 5A

| | Parity (506) | Bit 1 (508A) | Bit 2 (508B) | Bit 3 (508C) | Bit 4 (508D) |
|---|---|---|---|---|---|
| Example 1 (502) | 0 | 0 | 0 | 1 | 1 |
| Example 2 (504) | 1 | 1 | 0 | 1 | 0 |

Fig. 5B

ROBUST BIT SCHEME FOR A MEMORY OF A REPLACEABLE PRINTER COMPONENT

THE FIELD OF THE INVENTION

The present invention relates to printers and to memories for printers. More particularly, the invention relates to a robust bit scheme for a memory of a replaceable printer component.

BACKGROUND OF THE INVENTION

The art of inkjet technology is relatively well developed. Commercial products such as computer printers, graphics plotters, and facsimile machines have been implemented with inkjet technology for producing printed media. Generally, an inkjet image is formed pursuant to precise placement on a print medium of ink drops emitted by an ink drop generating device known as an inkjet printhead assembly. An inkjet printhead assembly includes at least one printhead. Typically, an inkjet printhead assembly is supported on a movable carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

Inkjet printers have at least one ink supply. An ink supply includes an ink container having an ink reservoir. The ink supply can be housed together with the inkjet printhead assembly in an inkjet cartridge or pen, or can be housed separately. When the ink supply is housed separately from the inkjet printhead assembly, users can replace the ink supply without replacing the inkjet printhead assembly. The inkjet printhead assembly is then replaced at or near the end of the printhead life, and not when the ink supply is replaced.

Current printer systems typically include one or more replaceable printer components, including inkjet cartridges, inkjet printhead assemblies, and ink supplies. Some existing systems provide these replaceable printer components with on-board memory to communicate information to a printer about the replaceable component. The on-board memory, for an inkjet cartridge for example, may store information such as pen type, unique pen code, ink fill level, marketing information, as well as other information. Such a memory may also store other information about the ink container, such as current ink level information. The ink level information can be transmitted to the printer to indicate the amount of ink remaining. A user can observe the ink level information and anticipate the need for replacing a depleted ink container.

If the data received by a printer from a printer component memory contains an error, the printer may perform an incorrect action, or may be unable to use the printer component. Such an error may be the result of a short circuit or open circuit in an address line coupling the memory to other printer components, such as a printer controller, or from some other problem.

It is desirable to have a memory scheme that is more robust than current memory schemes used in replaceable printer components to detect and correct errors and provide uninterrupted operation.

SUMMARY OF THE INVENTION

One aspect of the present invention provides a method for detecting an error in data received from a memory of a replaceable printer component. The memory includes a plurality of bits. The method includes providing a first parity bit associated with a first data item. The first data item and the first parity bit are stored in the printer memory. The printer includes a plurality of electrically conductive lines. At least one of the electrically conductive lines is associated with each bit. The first data item and the first parity bit are read from the memory. An electrical test of at least one of the electrically conductive lines is performed. An error in the first data item is identified based on the first parity bit read from the memory and the electrical test.

One aspect of the invention is directed to a printing system including a printhead for selectively depositing ink drops on print media. An ink supply stores ink to be provided to the printhead. A memory device stores a first parity bit and a first data item. The first parity bit is associated with the first data item. A processor is coupled to the memory device by a plurality of electrically conductive lines. The processor is responsive to output of the memory device. The processor performs an electrical test of at least one of the electrically conductive lines. The processor identifies an error in the first data item based on the first parity bit and the electrical test.

Another aspect of the invention is directed to a cartridge for a printing system having a controller. The cartridge includes a printhead assembly having at least one printhead that selectively deposits ink drops on print media. An ink supply stores ink to be provided to the printhead. An information storage device stores a first parity bit and a first data item. The first parity bit is associated with the first data item. The first parity bit is used by the controller in conjunction with an electrical test of electrically conductive lines coupled to the information storage device to identify an error in the first data item.

Another aspect of the invention is directed to a replaceable printer component having an integral memory for use in a printing system. The component includes a semiconductor die and a plurality of circuits formed on the semiconductor die. Each circuit is associated with and indicates the state of a bit in the memory. The memory stores a plurality of functional bits that must match values expected by the printing system for proper operation of the printing system. The memory stores a plurality of informational bits that are not critical to proper operation of the printing system. A large percentage of the circuits associated with the functional bits are positioned substantially near a center of the semiconductor die. A large percentage of the circuits associated with the informational bits are positioned substantially outside of the center of the semiconductor die.

Another aspect of the invention is directed to a method of storing information in a replaceable printer component having an integral memory. The replaceable printer component is employed in a printing system. The method includes providing a semiconductor die with a plurality of circuits formed on the semiconductor die. Each circuit is associated with and indicates the state of a bit in the memory. The method includes identifying functional bit fields related to the replaceable printer component that must match values expected by the printing system for proper operation of the printing system. The method includes identifying informational bit fields related to the replaceable printer component that are not critical to the proper operation of the printing system. The method includes storing a large percentage of the functional bit fields in the semiconductor die using circuits that are positioned substantially near a center of the semiconductor die and storing a large percentage of the functional bit fields in the semiconductor die using circuits that are positioned substantially near a center of the semiconductor die.

BRIEF DESCRIPTION OF THE DRAWINGS

FIG. 5A is a table illustrating two examples of bit assignments in one embodiment of an inkjet cartridge memory according to the present invention.

FIG. 5B is a table illustrating the bit assignments of FIG. 5A after an error has occurred.

DESCRIPTION OF THE PREFERRED EMBODIMENTS

In the following detailed description of the preferred embodiments, reference is made to the accompanying drawings that form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
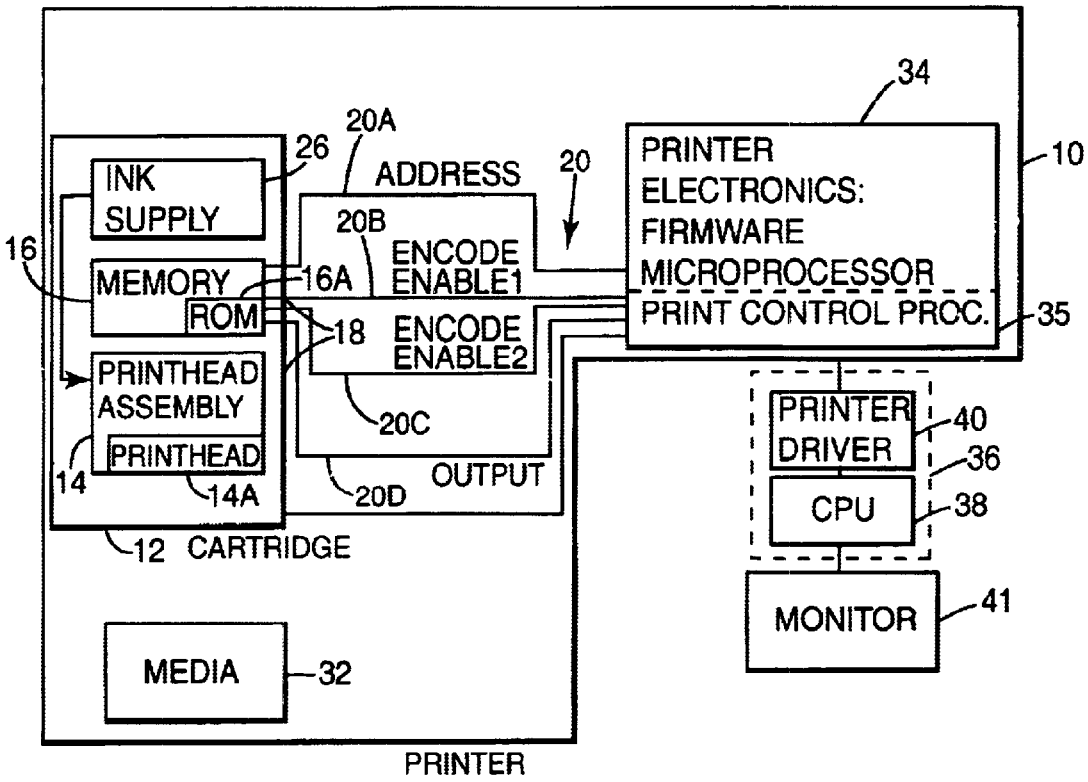
FIG. 1 is an electrical block diagram of major components of one embodiment of an inkjet printer according to the present invention.

FIG. 1 is an electrical block diagram of major components of an inkjet printer according to the present invention. Inkjet printer 10 includes removable inkjet cartridge 12, which includes an inkjet printhead assembly 14, an integrally mounted memory 16, and an ink supply 26. Inkjet cartridge 12 is pluggably removable from printer 10 via interconnects 18. Inkjet printhead assembly 14 includes at least one printhead 14A. Memory 16 may include multiple forms of memory, including RAM, ROM and EEPROM, and stores data associated with inkjet printhead assembly 14 and ink supply 26. In one embodiment, memory 16 includes factory-written data and printer-recorded data. In one embodiment, memory 16 includes a 26-bit ROM 16A, having 13 fusible bits, and 13 masked bits. In an alternative embodiment, all 26 bits are fusible bits. In another form of the present invention, all 26 bits are masked bits. ROM 16A can also include a different number of total bits, other than 26 bits. An advantage of using both fusible and masked bits is that a size reduction in ROM 16A may be obtained. Each fusible bit may be set by blowing a resistor in a circuit 400A (shown in FIG. 4A) representing the fusible bit. Each masked bit may be set by adding a resistor in a circuit 400B (shown in FIG. 4B) representing the masked bit. In one embodiment, ROM 16A is integrated with inkjet printhead assembly 14. In an alternative embodiment, ROM 16A may be integrated with ink supply 26. It will be understood by one of ordinary skill in the art that, rather than incorporating inkjet printhead assembly 14 and ink supply 26 into an inkjet cartridge 12, inkjet printhead assembly 14 and ink supply 26 may be separately housed and may include separate memories.

Printer 10 includes communication lines 20 for communications between inkjet cartridge 12 and controller 34. Communication lines 20 specifically include address lines 20A, first encode enable line 20B, second encode enable line 20C, and output line 20D, which are all connected to ROM 16A. In one embodiment, address lines 20A include 13 address lines. First encode enable line 20B is used to select fusible bits in ROM 16A, and second encode enable line 20C is used to select masked bits in ROM 16A. Address lines 20A are used to select a particular fusible bit or masked bit. The value of a selected fusible or masked bit is read by sensing the output on output line 20D.

Inkjet printhead assembly 14, memory 16, and ink supply 26 are connected to controller 34, which includes both electronics and firmware for the control of the various printer components or sub-assemblies. A print control procedure 35, which may be incorporated in the printer driver, causes the reading of data from memory 16 and adjusts printer operation in accordance with the data accessed from memory 16. Controller 34 controls inkjet printhead assembly 14 and ink supply 26 to cause ink droplets to be ejected in a controlled fashion on print media 32.

A host processor 36 is connected to controller 34, and includes a central processing unit (CPU) 38 and a software printer driver 40. A monitor 41 is connected to host processor 36, and is used to display various messages that are indicative of the state of inkjet printer 10. Alternatively, printer 10 can be configured for stand-alone or networked operation wherein messages are displayed on a front panel of the printer.

Figure 2:
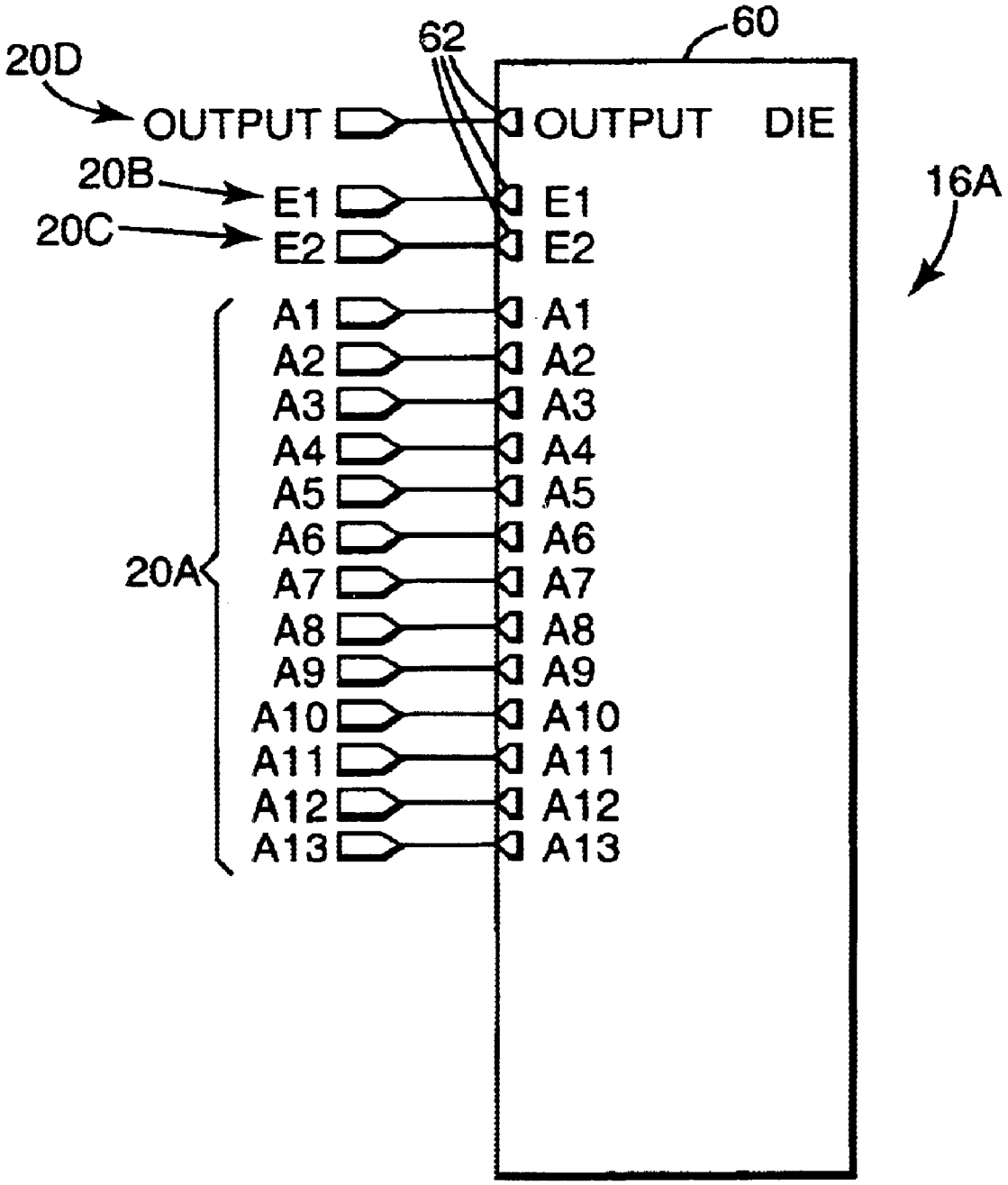
FIG. 2 is a diagram illustrating one embodiment of a ROM of the printer shown in FIG. 1.

FIG. 2 is a diagram illustrating ROM 16A of FIG. 1 in additional detail. ROM 16A includes semiconductor die 60 having a plurality of pads 62. Address lines 20A, first encode enable line (E1) 20B, second encode enable line (E2) 20C, and output line 20D are coupled to semiconductor die 60 via pads 62. Address lines 20A include 13 address lines (A1–A13). In one embodiment, ROM 16A includes other electrical connections (not shown), including ground connections.

Figure 3:
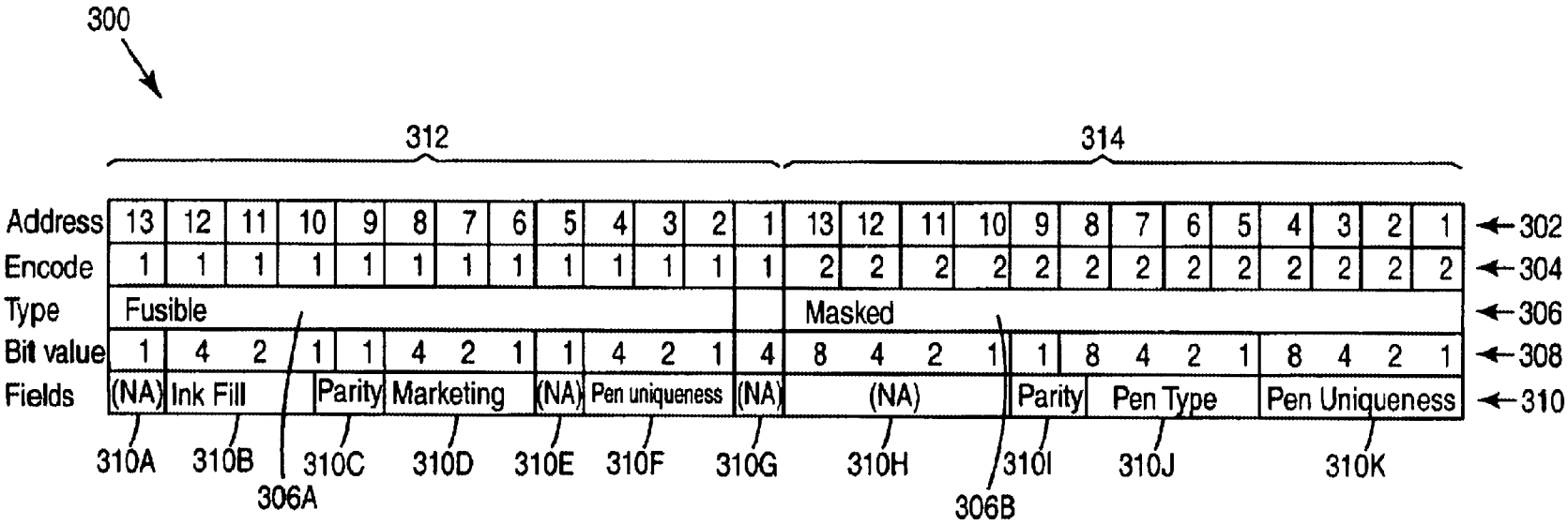
FIG. 3 is a table illustrating information stored in one embodiment of an inkjet cartridge memory according to the present invention.

FIG. 3 is a table illustrating information stored in ROM 16A according to the present invention. Table 300 includes address line identifiers 302, encode enable line identifiers 304, bit type identifiers 306A and 306B (collectively referred to as bit type identifiers 306), bit values 308, and fields 310. Table 300 is divided into portion 312 and portion 314. Portion 312 of table 300 represents information associated with fusible bits, as indicated by fusible type identifier 306A. Portion 314 of table 300 represents information associated with masked bits, as indicated by masked type identifier 306B. As mentioned above, rather than using both fusible and masked bits, all bits in ROM 16A may be fusible bits, or all bits in ROM 16A may be masked bits. Each one of the address line identifiers 302 represents one of address lines 20A, and corresponds to either a fusible bit or a masked bit. Both the fusible and the masked bits are numbered 1–13, indicating the particular address line 20A associated with the bit. Encode enable line identifiers 304 indicate the encode enable line 20B or 20C that must be set in order to select the corresponding bit. A "1" in encode enable line identifiers 304 corresponds to first encode enable line 20B, which is used to select fusible bits. A "2" in encode enable line identifiers 304 corresponds to second encode enable line 20C, which is used to select masked bits.

Fusible bits 1–13 and masked bits 1–13 are divided into a plurality of fields 310. Each bit in a particular field 310 includes a bit value 308. When a bit is set, it has the value indicated in its corresponding bit value 308. When a bit is not set, it has a value of 0. In one embodiment, fusible bits 1–13 and masked bits 1–13 are set during manufacture of ROM 16A.

Field 310A includes fusible bit 13. In one embodiment, fusible bit 13 is not used to store data, so field 310A includes the letters "NA" (i.e., not assigned).

Ink fill field 310B includes fusible bits 10–12. In one embodiment, fusible bits 10–12 provide a reference level or trigger level to determine when a low ink warning should be displayed.

Parity field 310C includes fusible bit 9. In one embodiment, fusible bit 9 is a parity bit used in association with the bits corresponding to marketing field 310D. In an alternative embodiment, fusible bit 9 is a parity bit used in association with multiple ones of the fields 310. Fusible bit 9 may also be used in association with memory bits associated with another printer component, such as ink supply 26.

Marketing field 310D includes fusible bits 6–8. In one embodiment, fusible bits 6–8 are used to identify whether an inkjet cartridge can be used in a particular printer.

Field 310E includes fusible bit 5. In one embodiment, fusible bit 5 is not used to store data, so field 310E includes the letters "NA" (i.e., not assigned).

Pen uniqueness field 310F includes fusible bits 2–4. In one embodiment, fusible bits 2–4 represent a random number that uniquely identifies an inkjet cartridge, which allows printer controller 34 to determine when a new inkjet cartridge has been installed.

Field 310G includes fusible bit 1. In one embodiment, fusible bit 1 is not used to store data, so field 310G includes the letters "NA" (i.e., not assigned).

Field 310H includes masked bits 10–13. In one embodiment, masked bits 10–13 are not used to store data, so field 310H includes the letters "NA" (i.e., not assigned).

Field 310I includes masked bit 9. In one embodiment, masked bit 9 is a parity bit used in association with the bits corresponding to pen type field 310J. In an alternative embodiment, masked bit 9 is a parity bit used in association with multiple ones of the fields 310. Masked bit 9 may also be used in association with memory bits associated with another printer component, such as ink supply 26.

Pen type field 310J includes masked bits 5–8. In one embodiment, masked bits 5–8 provide an identification of the type of inkjet cartridge that is associated with the memory.

Pen uniqueness field 310K includes masked bits 1–4. In one embodiment, masked bits 1–4 represent a random number that uniquely identifies a particular inkjet cartridge, which allows printer controller 34 to determine when a new inkjet cartridge has been installed.

Figure 4B:
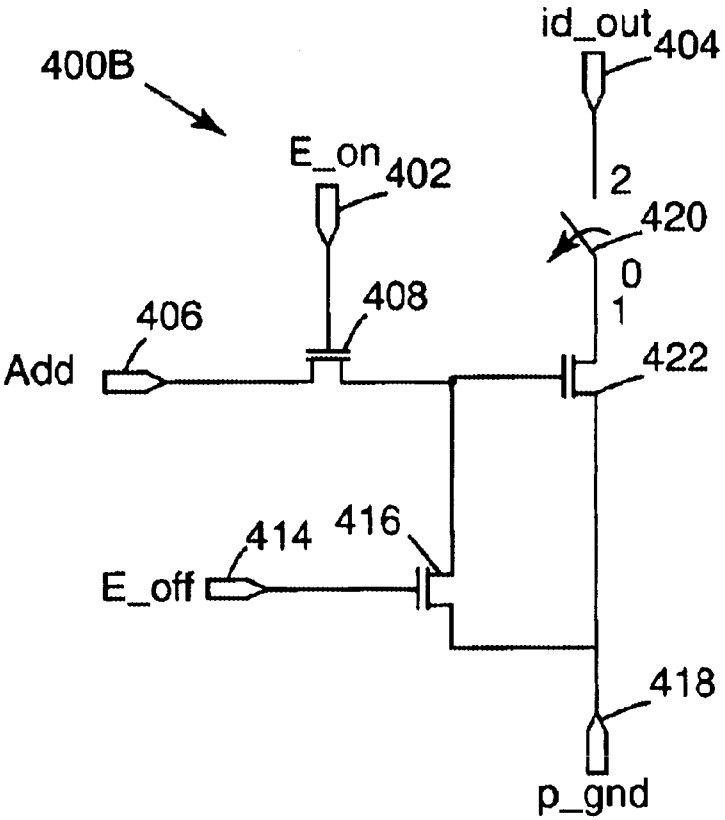
FIG. 4B is a schematic diagram of one embodiment of a circuit for defining the state of a masked bit of one embodiment of an inkjet cartridge memory of the present invention.
Figure 4A:
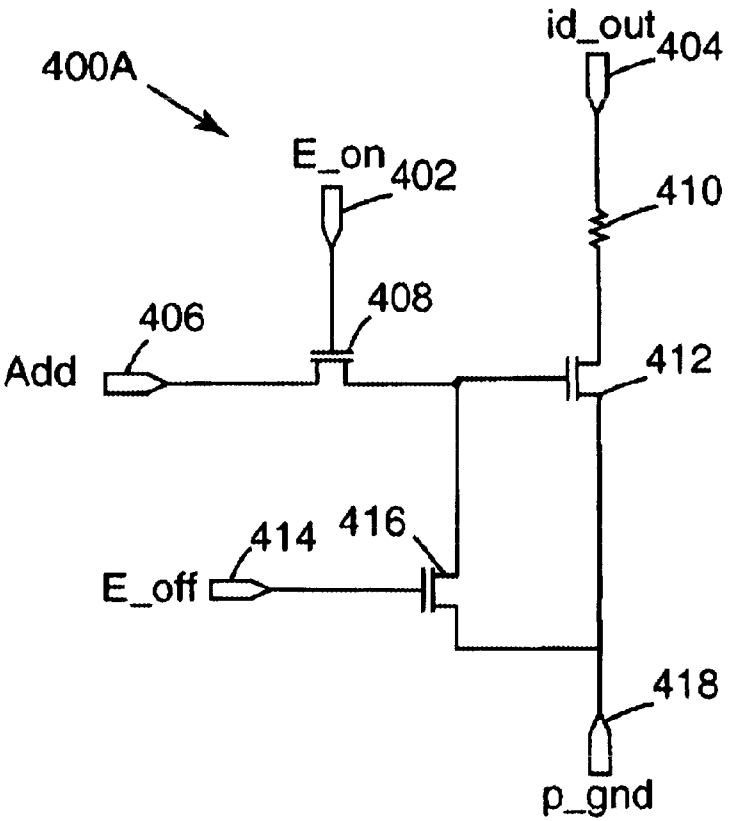
FIG. 4A is a schematic diagram of one embodiment of a circuit for defining the state of a fusible bit of one embodiment of an inkjet cartridge memory of the present invention.

FIG. 4A is a schematic diagram of a circuit for defining the state of a fusible bit in ROM 16A. Circuit 400A includes first encode enable input (E_on) 402, output (id_out) 404, address input 406, transistor 408, resistor 410, transistor 412, second encode enable input (E_off) 414, transistor 416, and ground (p_gnd) 418. Address input 406 is coupled to one of address lines 20A (shown in FIG. 1). First encode enable input 402 is coupled to first encode enable line 20B (shown in FIG. 1). Second encode enable input 414 is coupled to second encode enable line 20C (shown in FIG. 1). Output 404 is coupled to output line 20D (shown in FIG. 1).

In one embodiment, each of transistors 408, 412 and 416 is a field effect transistor (FET). Address input 406 is coupled to the drain of transistor 408. First encode enable input 402 is coupled to the gate of transistor 408. The source of transistor 408 is coupled to the gate of transistor 412 and the drain of transistor 416. The gate of transistor 416 is coupled to second encode enable input 414. The drain of transistor 416 is coupled to the source of transistor 408 and the gate of transistor 412. The source of transistor 416 is coupled to ground 418. Resistor 410 is positioned between output 404 and the drain of transistor 412. The source of transistor 412 is coupled to ground 418.

A fusible bit in ROM 16A, such as the bit represented by circuit 400A, is read by setting first encode enable input 402 high, setting address input 406 high, and sensing the signal at output 404. First encode enable input 402 is set high by controller 34 by setting first encode enable line 20B high. Address input 406 is set high by controller 34 by setting the address line 20A coupled to address input 406 high. The output voltage at output 404 is sensed by controller 34 by sensing the voltage on output line 20D.

Transistor 408 acts as an AND gate, with inputs 402 and 406. If inputs 402 and 406 are both high, a current flows through transistor 408, turning on transistor 412. Transistor 412 acts as a drive transistor, driving output 404. If resistor 410 is blown, the voltage at output 404 will be high, indicating a logical 1. If resistor 410 is not blown, the voltage at output 404 will be low, indicating a logical 0. Transistor 416 is used as an active pull down to prevent leakage current from transistor 408 from turning on transistor 412 when transistor 412 should be off. Transistor 416 is turned on by setting second encode enable input 414 high. When turned on, transistor 416 diverts current from transistor 408 to ground.

In one embodiment, transistors 408 and 416 each have a length of about 4 micrometers and a width of about 15.5 micrometers, and transistor 412 has a length of about 4 micrometers and a width of about 600 micrometers. In one embodiment, resistor 410 has a resistance of over about 1000 ohms when blown, and a resistance of under about 400 ohms when not blown. In addition to blowing resistor 410, other methods may be used to create an open circuit to define the state of a bit in ROM 16A, including mechanical cutting, laser cutting, as well as other methods.

FIG. 4B is a schematic diagram of a circuit for defining the state of a masked bit in ROM 16A. Circuit 400B is substantially the same as circuit 400A shown in FIG. 4A, with the exceptions that resistor 410 is replaced by switch 420, and transistor 422 includes different properties than transistor 412. In one embodiment, switch 420 is not an actual physical switch, but represents either the presence or absence of a resistor. If a resistor is present in place of switch 420, the resistor has sufficient resistance to act as an open circuit between output 404 and transistor 422. If a resistor is not present in place of switch 420, there is no additional resistance between output 404 and transistor 422. In one embodiment, transistor 422 is a field effect transistor (FET), with a length of about 4 micrometers and a width of about 100 micrometers.

Address input 406 is coupled to one of address lines 20A (shown in FIG. 1). First encode enable input 402 is coupled to second encode enable line 20C (shown in FIG. 1). Second encode enable input 414 is coupled to first encode enable line 20B (shown in FIG. 1). Output 404 is coupled to output line 20D (shown in FIG. 1).

Address input 406 is coupled to the drain of transistor 408. First encode enable input 402 is coupled to the gate of transistor 408. The source of transistor 408 is coupled to the gate of transistor 422 and the drain of transistor 416. The gate of transistor 416 is coupled to second encode enable input 414. The drain of transistor 416 is coupled to the source of transistor 408 and the gate of transistor 422. The source of transistor 416 is coupled to ground 418. Switch 420 is positioned between output 404 and the drain of transistor 422. The source of transistor 422 is coupled to ground 418.

A masked bit in ROM 16A, such as the bit represented by circuit 400B, is read by setting first encode enable input 402 high, setting address input 406 high, and sensing the signal at output 404. First encode enable input 402 is set high by controller 34 by setting second encode enable line 20C high. Address input 406 is set high by controller 34 by setting the address line 20A coupled to address input 406 high. The output voltage at output 404 is sensed by controller 34 by sensing the voltage on output line 20D.

Transistor 408 acts as an AND gate, with inputs 402 and 406. If inputs 402 and 406 are both high, a current flows through transistor 408, turning on transistor 422. Transistor 422 acts as a drive transistor, driving output 404. If switch 420 is open (i.e., resistor present), the voltage at output 404 will be high, indicating a logical 1. If switch 420 is closed (i.e., resistor not present), the voltage at output 404 will be low, indicating a logical 0. Transistor 416 is used as an active pull down to prevent leakage current from transistor 408 from turning on transistor 422 when transistor 422 should be off. Transistor 416 is turned on by setting second encode enable input 414 high. When turned on, transistor 416 diverts current from transistor 408 to ground.

In ROM 16A of the present invention, fusible and masked bits may be further classified as either functional or informational. Functional bit fields must match values expected by the printer for proper operation. An example of a functional bit field is pen type field 310J. If the bits corresponding to pen type field 310J indicate a type of inkjet cartridge that is not compatible with the printer, the printer may disable the inkjet cartridge. Thus, an error in pen type field 310J could cause the printer to improperly disable an inkjet cartridge. Informational bit fields are not critical to proper operation and may be ignored, or action may be taken based on incorrect information in an informational bit field without causing a stoppage in operation. Examples of informational bit fields include pen uniqueness fields 310F and 310K.

Short circuits caused by stray ink ("ink shorts") in an inkjet cartridge ROM 16A typically occur more frequently toward the edges of the semiconductor die 60 (shown in FIG. 2). Pads 62 that are positioned near the edges of semiconductor die 60 tend to suffer from corrosion, potentially causing electrical failures. In one embodiment, functional bits and other important bits, such as parity bits, are positioned toward the center of semiconductor die 60 to reduce the likelihood of ink shorts with respect to these bits, and thereby provide a more robust ROM 16A. In one embodiment, marketing bits 310D, pen type bits 310J, and parity bits 310C and 310I are positioned substantially near the center of semiconductor die 60.

In one embodiment, to further improve the robustness of an inkjet cartridge ROM 16A according to the present invention, parity bits are assigned to important bit fields, including functional bit fields. As shown in FIG. 3, a parity bit 310C is assigned to marketing bit field 310D, and a parity bit 310I is assigned to pen type bit field 310J. The use of parity bits, such as parity bits 310C and 310I, to improve the robustness of an inkjet cartridge ROM, is discussed in further detail below with reference to FIGS. 5A and 5B.

FIG. 5A is a table illustrating two examples of bit assignments in an inkjet cartridge ROM according to the present invention. The table includes lines 502 and 504, and columns 506 and 508A–D. Column 506 includes the value of a parity bit for each example, such as parity bit 310C or 310I. Columns 508A–D include the value of bits in a data bit field for each example, such as marketing field 310D or pen type field 310J. In Example 1, shown on line 502, the parity bit is set to 0, bit 1 is set to 0, bit 2 is set to 0, bit 3 is set to 1, and bit 4 is set to 1. In Example 2, shown on line 504, the parity bit is set to 1, bit 1 is set to 1, bit 2 is set to 0, bit 3 is set to 0, and bit 4 is set to 0.

In one embodiment, even parity is used in determining what value to assign to the parity bits. Since bits 1–4 in Example 1 add up to an even number, the parity bit for Example 1 is set to 0 to maintain an even number for the sum of bits 1–4 and the parity bit. Since bits 1–4 in Example 2 add up to an odd number, the parity bit for Example 2 is set to 1 to produce an even number for the sum of bits 1–4 and the parity bit. In an alternative embodiment, odd parity is used rather than even parity.

FIG. 5B is a table illustrating the bit assignments of FIG. 5A after an error in the data bit fields has occurred. It is assumed in FIG. 5B that an ink short has occurred in the address line 20A corresponding to data bit 3. Controller 34 determines whether any of address lines 20A has a short circuit or open circuit by electrically testing each of address lines 20A. In one embodiment, the electrical test includes a check for continuity. Techniques for testing electrically conductive lines and electric circuits are known to those of ordinary skill in the art. After electrically testing address lines 20A, controller 34 determines that the address line 20A corresponding to bit 3 has a short. When an ink short occurs in an address line, the output read by controller 34 will be a 1, regardless of whether the bit was a 1 prior to the ink short. Thus, bit 3 is a 1 for both Example 1 and Example 2 in FIG. 5B, even though bit 3 in Example 2 should be a 0 as shown in FIG. 5A.

In Example 1, controller 34 examines the parity bit to determine if the data bit field contains an error. Since the sum of bits 1–4 and the parity bit is an even number, controller 34 determines that the data bit field does not contain an error.

In Example 2, after examining the parity bit to determine if the data bit field contains an error, controller 34 determines that an error occurred, since the sum of bits 1–4 and the parity bit is an odd number, and even parity is being used. Based on the electrical test of the address line corresponding to bit 3, which indicated an ink short, and the determination from the parity test that an error occurred, controller 34 determines that bit 3 should be a 0, and corrects the bit accordingly. Thus, the error does not cause an interruption in the operation of printer 10.

Although specific embodiments have been illustrated and described herein for purposes of description of the preferred embodiment, it will be appreciated by those of ordinary skill in the art that a wide variety of alternate and/or equivalent implementations may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A method of detecting an error in data received from a memory of a replaceable printer component of a printer, the memory including a plurality of bits, the printer including a plurality of electrically conductive lines, at least one of the electrically conductive lines associated with each bit, the method comprising:

providing a first parity bit associated with a first data item, the first data item and the first parity bit stored in the memory;

reading the first data item and the first parity bit from the memory;

performing an electrical test of at least one of the electrically conductive lines; and identifying an error in the first data item based on the first parity bit read from the memory and the electrical test.

2. The method of claim 1, and further comprising:

identifying an electrical short circuit in at least one of the electrically conductive lines based on the electrical test, and wherein the error in the first data item is identified based on the first parity bit read from the memory and the identified electrical short circuit.

3. The method of claim 1, and further comprising:

identifying an open circuit in at least one of the electrically conductive lines based on the electrical test, and wherein the error in the first data item is identified based on the first parity bit read from the memory and the identified open circuit.

4. The method of claim 1, wherein the electrically conductive lines are address lines coupling the memory to a controller of the printer.

5. The method of claim 1, wherein the memory is a ROM.

6. The method of claim 1, and further comprising:

determining whether the replaceable printer component is appropriate for use in the printer based on the first data item.

7. The method of claim 1, and further comprising:

determining a type of the replaceable printer component installed in the printer based on the first data item.

8. The method of claim 7, and further comprising:

determining a type of cartridge installed in the printer based on the first data item.

9. The method of claim 1, and further comprising:

providing a second parity bit associated with a second data item, the second data item and the second parity bit stored in the memory;

reading the second data item and the second parity bit from the memory;

determining whether an error is contained in the second data item based on the second parity bit read from the memory.

10. The method of claim 1, wherein the memory is integrated with a cartridge.

11. The method of claim 1, wherein the memory is integrated with a printhead assembly.

12. The method of claim 1, wherein the memory is integrated with an ink supply.

13. A printing system comprising:

a printhead for selectively depositing ink drops on print media;

an ink supply for storing ink to be provided to the printhead;

a memory device for storing a first parity bit and a first data item, the first parity bit associated with the first data item; and a processor coupled to the memory device by a plurality of electrically conductive lines, the processor responsive to output of the memory device, the processor configured to read the first parity bit, the processor configured to perform an electrical test of at least one of the electrically conductive lines, the processor configured to identify an error in the first data item based on the first parity bit and the electrical test.

14. The printing system of claim 13, wherein the processor is configured to identify an electrical short circuit in at least one of the electrically conductive lines based on the electrical test, and wherein the processor is configured to identify the error in the first data item based on the first parity bit and the identified electrical short circuit.

15. The printing system of claim 13, wherein the processor is configured to identify an open circuit in at least one of the electrically conductive lines based on the electrical test, and wherein the processor is configured to identify the error in the first data item based on the first parity bit and the identified open circuit.

16. The printing system of claim 13, wherein the electrically conductive lines are address lines.

17. The printing system of claim 13, wherein the memory is a ROM.

18. The printing system of claim 17, wherein the ROM includes a semiconductor die and a plurality of circuits formed on the semiconductor die, each circuit associated with and indicating the state of a bit in the ROM.

19. The printing system of claim 18, wherein the circuits associated with the first data item are positioned substantially near a center of the semiconductor die.

20. The printing system of claim 18, wherein the circuit associated with the first parity bit is positioned substantially near a center of the semiconductor die.

21. The printing system of claim 13, wherein the processor is configured to determine whether a printer component is appropriate for use in the printing system based on the first data item.

22. The printing system of claim 13, wherein the processor is configured to determine a type of a printer component installed in the printing system based on the first data item.

23. The printing system of claim 22, wherein the processor is configured to determine a type of cartridge installed in the printing system based on the first data item.

24. The printing system of claim 13, wherein the memory stores a second parity bit and a second data item, the second parity bit associated with the second data item, and wherein the processor is configured to determine whether an error is contained in the second data item based on the second parity bit.

25. The printing system of claim 13, wherein the memory is integrated with a cartridge.

26. The printing system of claim 13, wherein the memory is integrated with a printhead assembly.

27. A cartridge for a printing system having a controller, comprising:

a printhead assembly having at least one printhead for selectively depositing ink drops on print media;

an ink supply for storing ink to be provided to the printhead; and an information storage device storing a first parity bit and a first data item, the first parity bit associated with the first data item, the first parity bit for use by the controller in conjunction with an electrical test of electrically conductive lines coupled to the information storage device to identify an error in the first data item.

28. The cartridge of claim 27, wherein the electrically conductive lines are address lines.

29. The cartridge of claim 27, wherein the information storage device is a ROM.

30. The cartridge of claim 29, wherein the ROM includes a semiconductor die and a plurality of circuits formed on the semiconductor die, each circuit associated with and indicating the state of a bit in the ROM.

31. The cartridge of claim 30, wherein the circuits associated with the first data item are positioned substantially near a center of the semiconductor die.

32. The cartridge of claim 30, wherein the circuit associated with the first parity bit is positioned substantially near a center of the semiconductor die.

33. The cartridge of claim 27, wherein the first data item indicates to the controller whether a printer component is appropriate for use in the printing system.

34. The cartridge of claim 27, wherein the first data item indicates a type of a printer component installed in the printing system.

35. The cartridge of claim 34, wherein the first data item indicates a type of cartridge installed in the printing system.

36. The cartridge of claim 27, wherein the information storage device stores a second parity bit and a second data item, the second parity bit associated with the second data item, the second parity bit for use by the controller to determine whether an error is contained in the second data item.

37. The cartridge of claim 27, wherein the information storage device is integrated with the printhead assembly.

38. A replaceable printer component having an integral memory for use in a printing system, the component comprising:

a semiconductor die; and a plurality of circuits formed on the semiconductor die, each circuit associated with and indicating the state of a bit in the memory; the memory storing a plurality of functional bits that must match values expected by the printing system for proper operation of the printing system, the memory storing a plurality of informational bits that are not critical to proper operation of the printing system, a large percentage of the circuits associated with the functional bits positioned substantially near a center of the semiconductor die, and wherein a large percentage of the circuits associated with the informational bits are positioned substantially outside of the center of the semiconductor die.

39. The replaceable printer component of claim 38, wherein substantially all of the circuits associated with the informational bits are positioned substantially outside of the center of the semiconductor die.

40. The replaceable printer component of claim 38, wherein the plurality of functional bits include bits representing a first data item that provides identifying information regarding the replaceable printer component, the bits representing the first data item useable by the printing system to determine whether the replaceable printer component is appropriate for use in the printing system, the circuits associated with the bits representing the first data item positioned substantially near a center of the semiconductor die.

41. The replaceable printer component of claim 38, wherein the replaceable printer component is a cartridge.

42. The replaceable printer component of claim 38, wherein the replaceable printer component is a printhead assembly.

43. The replaceable printer component of claim 38, wherein the replaceable printer component is an ink supply.

44. The replaceable printer component of claim 38, wherein substantially all of the circuits associated with the functional bits are positioned substantially near the center of the semiconductor die.

45. A method of storing information in a replaceable printer component having an integral memory, the replaceable printer component for use in a printing system, the method comprising:

providing a semiconductor die with a plurality of circuits formed on the semiconductor die, each circuit associated with and indicating the state of a bit in the memory;

identifying functional bit fields related to the replaceable printer component that must match values expected by the printing system for proper operation of the printing system;

identifying informational bit fields related to the replaceable printer component that are not critical to the proper operation of the printing system;

storing a large percentage of the functional bit fields in the semiconductor die using circuits that are positioned substantially near a center of the semiconductor die; and storing a large percentage of the informational bit fields in the semiconductor die using circuits that are positioned substantially outside of the center of the semiconductor die.

46. The method of claim 45, and further comprising:

storing substantially all of the functional bit fields in the semiconductor die using circuits that are positioned substantially near a center of the semiconductor die.

47. The method of claim 45, further comprising:

storing substantially all of the informational bit fields in the semiconductor die using circuits that are positioned substantially outside of the center of the semiconductor die.

48. The method of claim 45, wherein the plurality of functional bits include bits representing a first data item that provides identifying information regarding the replaceable printer component, the bits representing the first data item useable by the printing system to determine whether the replaceable printer component is appropriate for use in the printing system, the method further comprising:

storing the bits representing the first data item using circuits that are positioned substantially near a center a center of the semiconductor die.

* * * * *